US007387295B2

(12) United States Patent
Talbott

(10) Patent No.: US 7,387,295 B2
(45) **Date of Patent: *Jun. 17, 2008**

(54) TIRE FENCE

(75) Inventor: Alex F. Talbott, Louisville, KY (US)
(73) Assignee: Lifenet Softwalls, LLC, Louisville, KY (US)

( * ) Notice: Subject to any disclaimer, the term of this patent is extended or adjusted under 35 U.S.C. 154(b) by 283 days.

This patent is subject to a terminal disclaimer.

(21) Appl. No.: 10/513,714

(22) PCT Filed: May 15, 2003

(86) PCT No.: PCT/US03/14967

§ 371 (c)(1),
(2), (4) Date: Jun. 13, 2005

(87) PCT Pub. No.: WO03/097964

PCT Pub. Date: Nov. 27, 2003

(65) Prior Publication Data

US 2005/0236609 A1 Oct. 27, 2005

Related U.S. Application Data

(60) Provisional application No. 60/380,921, filed on May 16, 2002.

(51) Int. Cl.
*E01F 15/00* (2006.01)

(52) U.S. Cl. ..... 256/13.1; 256/1; 404/6; 404/9

(58) Field of Classification Search ..... 24/31 R, 24/31 L, 37, 38; 256/1, 13.1; 404/6, 9, 10
See application file for complete search history.

(56) References Cited

U.S. PATENT DOCUMENTS 460,799 A * 10/1891 Kelly ..... 24/38
3,764,446 A 10/1973 Martin
3,928,701 A 12/1975 Roehner
3,934,540 A 1/1976 Bruner
3,951,384 A 4/1976 Hildreth, Jr.
4,022,434 A 5/1977 Moore
4,188,153 A 2/1980 Taylor
4,629,360 A 12/1986 Cacossa et al.
4,785,577 A 11/1988 Lederbauer
5,006,014 A 4/1991 Greenough
5,011,327 A 4/1991 Thiac
5,056,961 A 10/1991 McMeans et al.
5,096,772 A 3/1992 Snyder
5,131,787 A 7/1992 Goldberg
5,178,489 A 1/1993 Suhayda
5,238,325 A 8/1993 Krenzler
5,284,326 A 2/1994 Chiovitti et al.

(Continued)

*Primary Examiner*—Daniel P. Stodola
*Assistant Examiner*—Michael P. Ferguson
(74) *Attorney, Agent, or Firm*—Woodard, Emhardt, Moriarty, McNett & Henry LLP

(57) ABSTRACT

Above ground fences are constructed with used tires from vehicles. Various arrangements of tires and inter-tire binding and anchorage of tires in place are disclosed. Usage for area fencing for animal containment, for privacy fencing, for limited privacy screening, for noise control, for roadway collision safety and for building wall protection are disclosed. Avoidance of collection and stagnation of water from rain, snow and sprinkling, is disclosed. The use of the tread portion of waste tires, for tire fence binding material, is disclosed.

9 Claims, 8 Drawing Sheets

U.S. PATENT DOCUMENTS 5,340,630 A 8/1994 Tripp
5,364,206 A 11/1994 Marienfeld
5,370,475 A 12/1994 LeBlanc
5,378,088 A 1/1995 Foehrkolb
5,412,921 A 5/1995 Tripp
5,480,255 A 1/1996 Bernaquez et al.
5,645,368 A 7/1997 Yunick
5,746,545 A 5/1998 Parker, Jr.
5,795,106 A 8/1998 Herd
5,834,083 A 11/1998 Pignataro, Jr.
5,873,208 A 2/1999 Nowacek
5,906,359 A 5/1999 Rowswell
6,151,859 A 11/2000 Nowacek
6,194,519 B1 2/2001 Blalock et al.
6,268,035 B1 7/2001 Carpenter
6,370,476 B1 4/2002 McBride
6,372,069 B1 4/2002 Walls
6,375,387 B1 * 4/2002 Gabor et al. ..... 405/18
6,427,411 B2 8/2002 Shows
6,457,912 B1 10/2002 Leibl
6,505,993 B1 * 1/2003 Diem ..... 404/6
6,520,711 B2 2/2003 Kim
6,527,891 B2 3/2003 Khadem
6,533,250 B2 3/2003 Arthur
6,533,501 B1 3/2003 Callinan
6,558,076 B2 5/2003 Liaw
6,896,449 B1 5/2005 Callinan et al.
6,905,281 B2 6/2005 Kang
2003/0010421 A1 1/2003 Coffin et al.
2003/0072904 A1 4/2003 Hansen
2003/0095835 A1 5/2003 Kupl et al.
2003/0156908 A1 8/2003 Liaw
2005/0236609 A1 10/2005 Talbott

* cited by examiner

TIRE FENCE

CROSS REFERENCE TO RELATED APPLICATION

This application is a PCT application based on U.S. provisional application Ser. No. 60/380,921 filed May 16, 2002 and from which priority is claimed.

BACKGROUND OF THE INVENTION

This invention relates to the safe disposal of used tires and the creation of useful fences from used tires.

My invention thus has important ecological benefits.

Scrap Tire Disposal

Every year in the United States there are 280 million scrap tires generated. While some used racing tires are used as temporary barriers at race tracks, and other proposed uses have been patented, there are possibly over a half billion scrap tires located in illegal dumpsites across the United States. The existence of these scrap tires creates environmental hazards and concerns. The tires collect and hold stagnant water, which becomes an excellent mosquito-breeding system. With the spread of the West Nile Flue virus by mosquitoes, this pestilence is more deadly and serious than ever before. The tires sometimes catch fire and, if they are in the customary unregulated pile, the fire is very difficult to extinguish. A burning tire pile will create black smoke, soot, terrible odor and serious air pollution. Residue from the burning also creates soil and ground-water pollution.

The potential for severe fire and/or smoldering of scrap tire stock piles exists across the United States. State and local landfills have become burdened by the large landfill resources required to dispose of used tires. In fact, most local and state authorities charge tire merchants a disposal fee of one to two dollars per standard automobile tire. Of course, this cost is normally passed on to the consuming public. Cradle-to-grave tracking systems like those applicable to toxic waste have been enacted to regulate the problem.

Threats of fines and other punishments have greatly reduced the problem, but at substantial costs to the consuming public and the handlers. This cost creates incentives to cheat on the regulatory system, and it is believed that many do. Figures published by the Rubber Manufacturers Association indicated that 60 million scrap tires per year remain unaccounted for.

Many novel ideas have been explored to convert the scrap tire liability into an asset because it is realized that economic benefit, rather than regulatory coercion, is the better solution. California alone spent $25 million in 2002 searching for an economic solution and has budgeted $28 million on the effort for 2003. Nearly every state has a similar program on a smaller scale. To-date, most ventures have been marginally successful at best, even with the subsidy of coercive threats.

Consumers pay $1.00 to $2.00 per tire for disposal plus $1.00 per tire average tax to the state to clean up illegal dumps. Clean-up costs for states have ranged from $0.75 to $10.00 per tire. The potential economic benefit gained from properly disposing of used tires has led many to attempt to solve the disposal problems noted above.

A common technique for disposing of whole tires is to shred the tires into discrete pieces and dumping the scraps into landfills. Although this decreases the overall landfill volume required for disposal and prevents tires from floating, it does not address other problems associated with tire disposal. First, the tires still prevent fire and/or contamination problems discussed above. Second, the process of shredding adds significant cost to the disposal process without any associated benefit. Moreover, mere shredding does not offer an alternative productive use for scrap tires and continues to present many landfill problems.

Recycling scrap tires into other commercially useful products offers another disposal alternative. Tires are often used to make other petroleum-based products, such as floor mats. However, because of the problems attributed to recycling, such as cost and lack of potential use, less than 7% of scrap tires are recycled in this matter. Accordingly, tire recycling has not proven to be a viable tire disposal alternative.

Attempts have been made to utilize scrap tires as an energy source. Specifically, furnaces have been developed to burn scrap tires in the creation of heat energy. This disposal technique has also proven of limited value. First, high capital cost associated with the development of furnaces has curtailed their widespread use. Moreover, other environmental concerns are associated with the burning of tires.

My invention minimizes both hazards by preventing the collection of water to eliminate mosquito breeding and by spreading the tires in long lines so that, if they do catch fire, the non-burning source of the fence, can easily and readily be removed from the burning portion so that the fire quickly burns itself out from the lack of a continuing source of fuel.

Five Primary Types of Fences

Large amounts of scrap tire casings could readily and economically be used to provide primarily five types of fences.

The first type would simply be an enclosure for farm animals or a boundary marker for farms and ranches. The second type would be a highway safety fence dividing lanes of opposite-bound traffic to prevent disastrous head-on collisions. A third would be a sound barrier fence to shield other areas of human activity from highway noise. And the fourth would be a wall around unsightly industrial or other areas to screen them from less unsightly uses. According to my invention, there are various means of arranging the tires in relation to one another and binding them together to create varying degrees of resistance to possible collision, highway noise, resistance to animals, visibility screening, and attractiveness. The cost of construction will be slightly affected by the method chosen.

Farm or Ranch Fencing

The bluegrass country of Kentucky is renowned for its beautiful stone fences that mark the boundaries of many large farms. The inventor imagines that the stones comprising these fences originally littered the fields making the fields difficult to till. Removing the stones from the fields made the fields more tillable and, when the stones were placed on the boundaries of the fields in the form of fences, the stones had less distance to be carried and became permanent boundary markers for the farm owner's field that endure for many years even without mortar and with little maintenance.

Old tires do not have quite the same proximity to their final resting place in the form of farm fences building blocks, as the stones in the fields did. But old tires are a ubiquitous problem nationwide, so these building blocks are not far from farmers and ranchers needing fences. Placing these building blocks in the form of farm or ranch fences would convert a serious societal and possessor liability into an asset that would endure for years with little or no maintenance, and this conversion would greatly reduce the initial construction cost of fencing to the farmer or rancher.

The problems with old tires and the needs of farmers and ranchers are thoroughly explained in the Moore Tire Fence U.S. Pat. No. 4,022,434. Advantages of my invention over the Moore Tire Fence include:

(1) The tires lay flat and are self-supporting and more stable, needing fewer expensive additions to make them function.

(2) They are easier to build and, if necessary, to repair, needing little, if any, non-tire accessories that would increase the cost.

(3) In the horizontal position, they are less subject to the ravages of gravity and other natural elements.

(4) Also, in the horizontal position, they are more aesthetic because, from the common perspective, they look less like construction from old tires.

Highway Collision Barrier Fence

With my invention embodied in its strongest form of fence as a wall, it is doubtful that such wall can be broken through by a collision with even a very heavy tractor trailer combination, a 70,000 pound 18-wheeler, for example. Also, in its strongest form, it creates a relatively "soft" barrier, which helps to protect the occupants of vehicles colliding with the wall, and protects those in highway lanes on the other side of the fence. This "soft" but strong and collision energy absorption effect occurs because the resistance of the fence grows and accumulates as the initial portions of the fence with which collision is made, are moved farther and farther from their initial position. The greater the movement of any portion of the fence, the greater the amount of the drag that is required to move it further, so long as the binding mechanism remains intact. This is because the original section of the fence moves rather easily but it must pull along more and more of the fence's weight in order to keep moving. The flex and resistance of the fence may be increased by constructing the wall in a wave pattern rather than a straight line. This wave pattern might be considered more aesthetically pleasing than a straight linear pattern. Finally, the wave pattern of construction will increase the stability of higher fences. In addition, if the fence is broken through or compromised in any way, it is easily and readily repaired or put back in place.

Highway safety engineers are faced with the problem of keeping separate many miles of traffic moving in opposite directions. Generally, the separation is maintained only by a little space and the alertness of the drivers. As that alertness breaks down, disasters occur and many families have been wiped out, not to mention the property damage done. Economically feasible solutions have not been found. Society is plagued with a superabundance of waste tires that endure the natural elements indefinitely and take tremendous punishment without noticeable effects. Both of these problems can be solved simultaneously by my invention, creating an inexpensive and effective deterrent to head-on collisions.

Highway Noise Barrier Fences

The proliferation of superhighways and widening of existing highways have required that they pass near residential neighborhoods and other areas of human activity where the noise from such highways causes a substantial nuisance to the proper enjoyment and use of the neighboring property. More and more, highway engineers are taking note of the problem and attempting to solve it with various types of noise barriers, usually taking the form of walls that are both unsightly and expensive. An effort to incorporate rubber salvaged from waste tires has been shown to increase the effectiveness of the noise abating qualities of such walls, apparently by decreasing its echoing ability.

An effective noise abatement wall made from waste tires would, in its preferred embodiment, need to be free of gaps. It would be constructed preferably as shown in FIGS. 5 and 6 herein. The visual aspects of such a wall could be improved by covering it with vines that also bind the tires together. Vines may also increase its noise abatement qualities by providing additional irregular, flexible material to absorb sound waves. This gap-free construction of the sound barrier wall fence would increase the amount of waste tires to be disposed of in a given area and would increase the rigidity of the fence.

Visibility Screening Fence

Many industrial and commercial uses are considered to be unsightly. Screening efforts have even been enacted into law to surround such uses as junkyards and landfills. While not all uses demand screening laws in all situations, intense uses will more likely be allowed by land use permitting officials in some situations, if the requested use can be screened appropriately from nearby sensitive uses.

Efforts to provide such screening sometimes fail because attractive screening is expensive, and inexpensive screening frequently deteriorates to become less attractive than the use it is supposed to hide.

Scrap tires will never be made into a thing of beauty. The fact that they are readily recognized as waste, and the fact that they frequently are discarded in areas of otherwise pristine beauty, creates a natural aesthetic prejudice that probably cannot be overcome. However, placing tires to create orderliness and purpose may succeed in overcoming some of this adverse impression. By analogy, stones strewn haphazardly throughout a field are ugly to a farmer, but when removed from the field and placed by artisans to become a boundary wall, the stone walls become a thing of beauty. Their durability and low maintenance adds both to their beauty and their profit making.

Interestingly, one of the least expensive walls to build from scrap tires may be the most attractive; that is, one where the only binding material is made of vines. When fully covered with vines, such a wall may appear to be a well-kept hedge. Such hedge-like walls could be used to screen parking lots, junkyards, or other intense uses that are generally considered unsightly.

In whatever way the screening wall is constructed from the tires, its creation, like the removal of stones from the field to build a boundary wall, serves the dual purpose of removing them from places where they are a problem, to place them where they are useful to human endeavors.

Bumper Fence

Industrial buildings, and in particular metal buildings, need vehicle bumpers to protect their exterior walls and, perhaps their interior walls, from bumps by trucks and other vehicles inside and outside of the building. Such a bumper could be formed from scrap tires deployed in the same manner as the tire fence around whatever needs the protection. Interior fence tires would not need a drain hole, and possibly, they would not need any binding material. Stacked against the wall of the building, the wall itself may be the only stabilization needed. If one or more tires are knocked out of position, they can quickly and easily be restored by hand.

The resistance to bumps can be increased by adding something rigid near the area likely to receive the bumps, which rigid member will press against more than one tire when the bump occurs. For example, a 2×6 plank of substantial length could be attached to the face of the bumper fence to receive the bump. This would further lessen the indirect force of the bump against the wall of the building to avoid damaging the wall.

If aesthetics are important, the bumper fence could be totally or partially covered with something flexible.

The space above the bumper fence could be made more useful by placing a rigid member above or simply resting it atop the bumper fence to create a shelf or counter. The shelf or counter should be set back from the face of the bumper fence to allow a reasonable amount of flex from the bumps the fence is designed to take, without contacting the shelf or counter.

Vehicle bumps are a major cause of the deterioration in appearance and functionality of metal buildings. Conventional methods of protecting walls against such hazards are either expensive or marginally effective. The tire bumper fence effectively protects the walls and is either cheap or conceivably free to the building owner. It finds a safe storage place for scrap tires and makes them functional, turning a liability into an asset with virtually no conversion costs. This use solves a societal problem as well as a problem of the building owner.

DESCRIPTION OF THE ILLUSTRATED EMBODIMENTS

Figure 2:
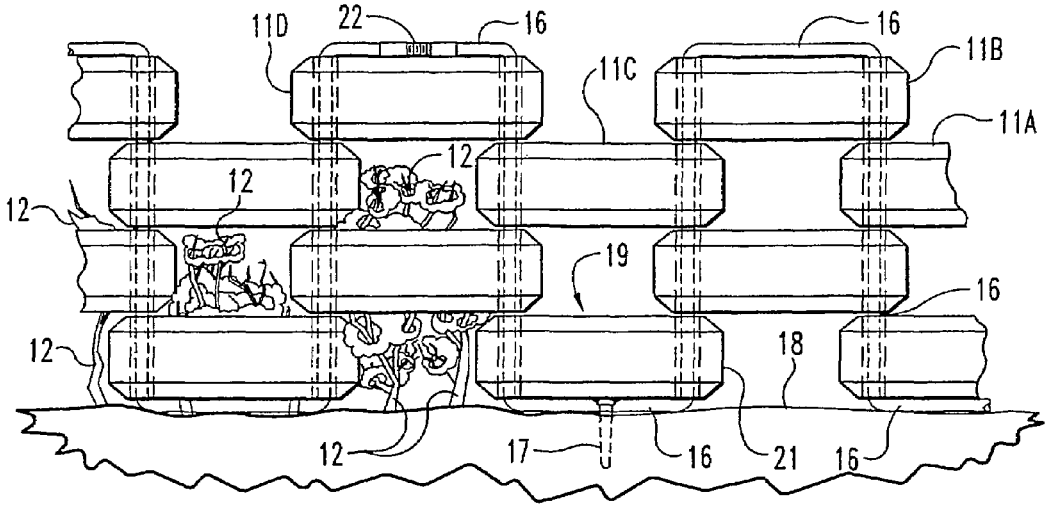
FIG. 2 is a side elevational view thereof taken on 2-2 in FIG. 1 and viewed in direction of the arrows.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
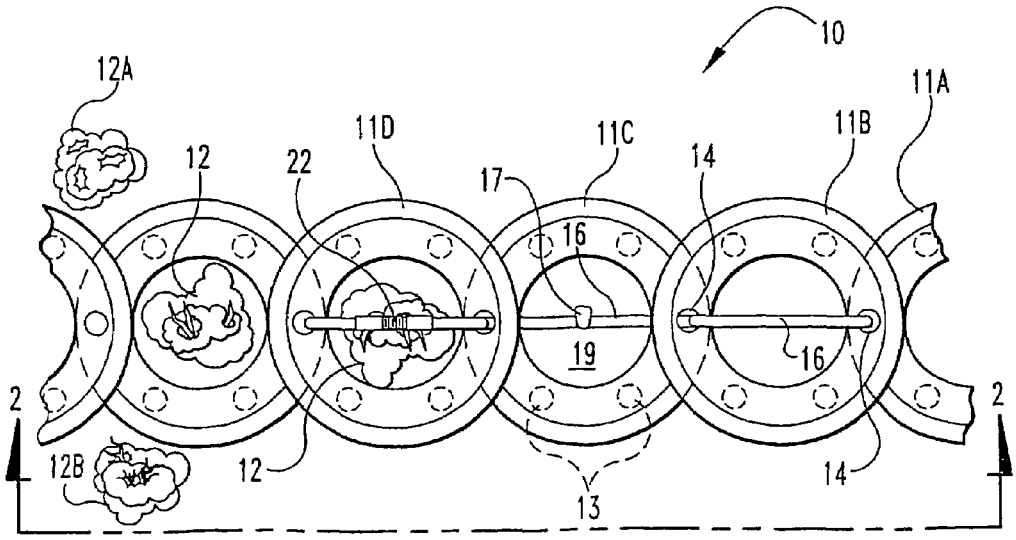
FIG. 1 is a fragmentary top plan view of a fence made of tires according to one embodiment of the present invention.

Referring now to FIGS. 1 and 2, FIG. 1 shows a portion of a fence 10 made of a row of tires 11 according to one embodiment of the invention. In this particular embodiment, as shown in the elevational view of FIG. 2, four levels of tires are stacked sidewall to sidewall. As such, they have an appearance similar to a brick wall in which the bricks within a course are spaced from each other and the bricks in one course are staggered with respect to the bricks in the next adjacent course. This arrangement provides openings between the bricks in a course, giving it an airy look like a fence rather than an opaque look like a wall. The spaces will also spread the bricks over a greater distance per tire for economy. The spaces can be useful for insertion of decorations, lights, or other items of interest in a brick wall. Since the tires to be used according to my invention are used tires, having central openings from which wheels have been removed, there is open space through the courses from the ground up as best shown in FIG. 1. Vegetative plantings (climbing vines, for example) can be made in the ground in these spaces, as shown at 12 in FIGS. 1 and 2, as well as along the sides of the row of tires as at 12A and 12B, for example.

Figure 7:
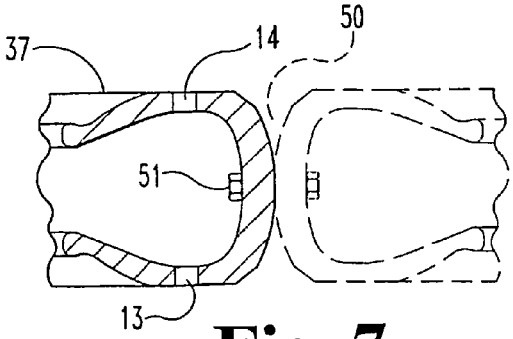
FIG. 7 is an enlarged cross section through a tire taken at line 7-7 in FIG. 5 and viewed in the direction of the arrows.

In FIGS. 1 and 2, the tires used are of the pneumatic type rubber tires. A cross section of such tires is usually similar to that shown in FIG. 7, as taken at line 7-7 through tire 37 in FIG. 5 and viewed in the direction of the arrows. For use according to the present invention, the downwardly facing sidewall of each tire is provided with holes as shown in dashed lines at 13, and are generally spaced in a circle centered on the axis of the tire. These holes facilitate drainage of water, which may otherwise accumulate in the tire as a result of rain or snow or crop sprinkling, for example. In the particular embodiment of the present invention shown in FIGS. 1 and 2, there are also two holes 14 in the upper sidewall of each of the tires. These holes receive binding device 16 which is woven through the holes 13 and 14 of the tires in the stacks, to hold the tires together in the organization shown in FIGS. 1 and 2. The binding device can be natural, synthetic, or metal wire rope or cable, or some such flexible device, and can be arranged in any manner desired, with anchors to the ground at various locations, if desired. One anchor example would be a steel stake at 17 driven into ground 18. This can be easily done many places along the length of the fence, as portions of the binding device 16 are exposed by the wheel openings such as 19 in the tire 21. Also, adjustable couplings such as 22 can be used between lengths of cable at convenient locations, such as at the portion of the cable 16 above the center of tire 11D. A turnbuckle or other adjustable coupling at such location 22 will be useful for connecting two ends of a cable or strap material, and either tightening or loosening the device, if desired. Normally, the weight of the tires themselves will be sufficient to hold them in place, but specific anchorage can be employed, if desired.

Figure 4:
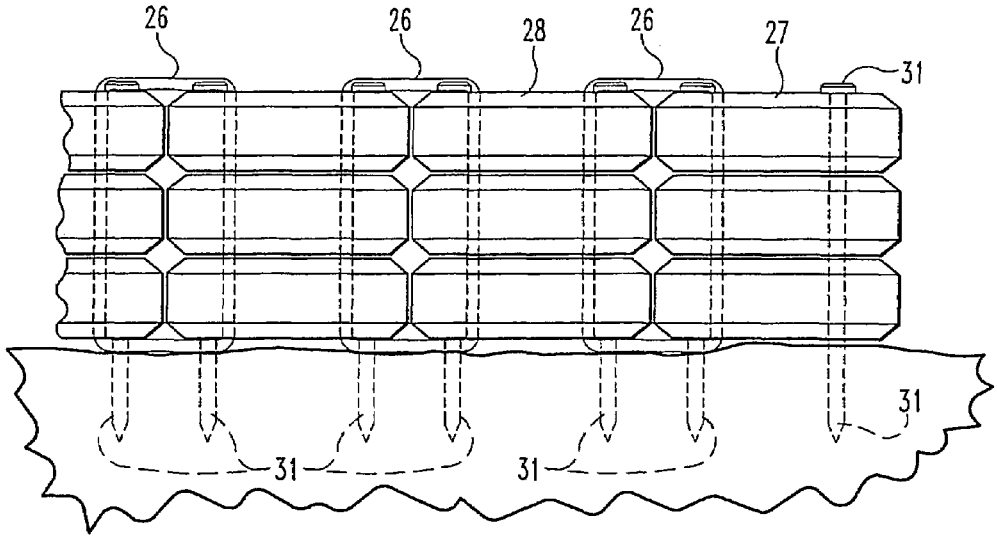
FIG. 4 is an elevational view thereof taken on line 4-4 in FIG. 3 and viewed in the direction of the arrows.
Figure 3:
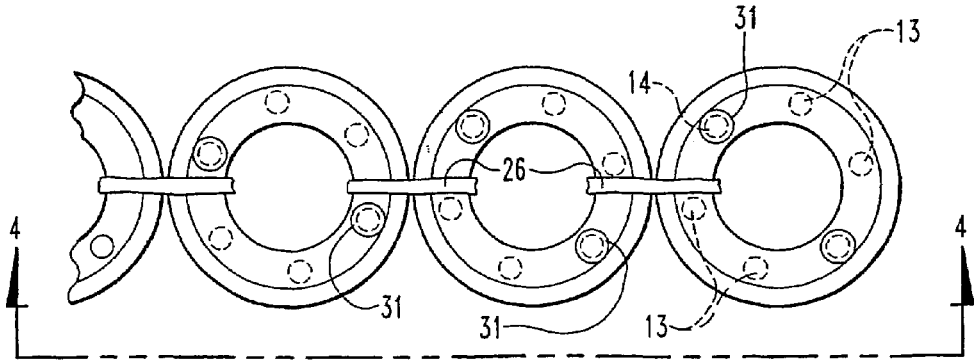
FIG. 3 is a fragmentary plan view of a fence according to another embodiment of the present invention.

Referring now to FIGS. 3 and 4, the tires in this embodiment of the invention are shown only three courses high, although they could be four, as in FIG. 2, or higher. In fact, if it is desired for the fence to be merely a curb at some location, a single course of tires would suffice. But in the FIG. 4 embodiment, the tires are laid in a manner similar to a "stack bond" in brick laying terms. In this case, the tires can be exactly like the tires 11 in the previously described embodiment, with a series of circularly spaced drainage holes in the bottom, as indicated by the dashed lines 13. In this example, the tires are bound together with binding devices such as 26 which, in this example, bind the adjacent tires in a stack together with adjacent tires in the next adjacent stack such as tires 27 in one stack being bound to the tires 28 in the next adjacent stack by binding devices 26. In this instance, the binding material is lengths of old tire tread which has been removed from the tire carcass to form a strap. Other binding material such as mentioned above may be used as well. The binding material goes down through the aligned center openings in the one stack of tires such as 27, under the adjacent treads of the bottom tires in each stack, and up through the center opening of the next adjacent stack 28 and so on through the successive stacks in the series. This type of fence, because of the absence of any gaps in it, can serve very well both as a visibility screening wall and a highway noise barrier fence. If desired, this wall can be easily anchored by pipes or rods 31 through the center holes or through holes such as vertically aligned holes 14 and 13 in the previously described embodiment. Such anchors can be installed before the bindings 26 are brought over the tops of the stack. Alternatively, the holes 14 can be indexed away from a line between the centers of adjacent tires as shown in FIG. 3. Such anchorage avoids reliance entirely on the weight of tires to keep them in the places on the ground chosen for the desired fence profile. However, a fence feature which can be achieved with the present invention, and useful for highway median sites, is flexibility. In that case some looseness or flexibility can be incorporated in the binding to absorb impact energy by letting tires move out of their original position by sliding on the around and along unused or loose portions of the binding devices. This lessens potential for separation of the fence sections upon collision from an out-of-control vehicle.

Figure 6:
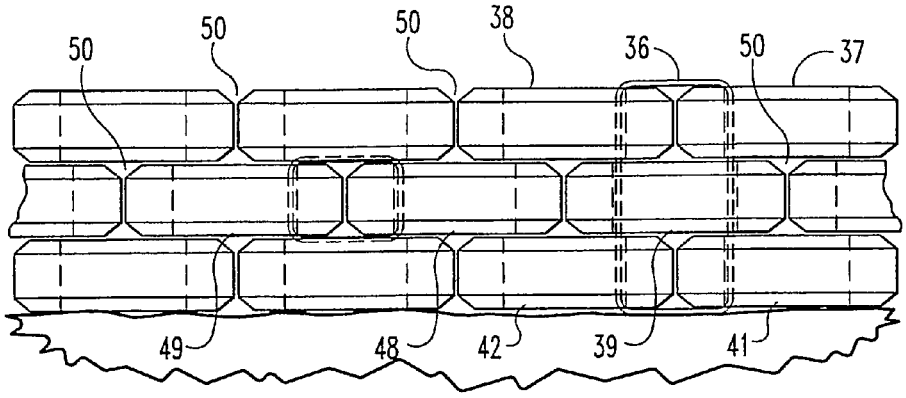
FIG. 6 is a fragmentary elevational view taken on line 6-6 in FIG. 5 and viewed in the direction of the arrows.
Figure 5:
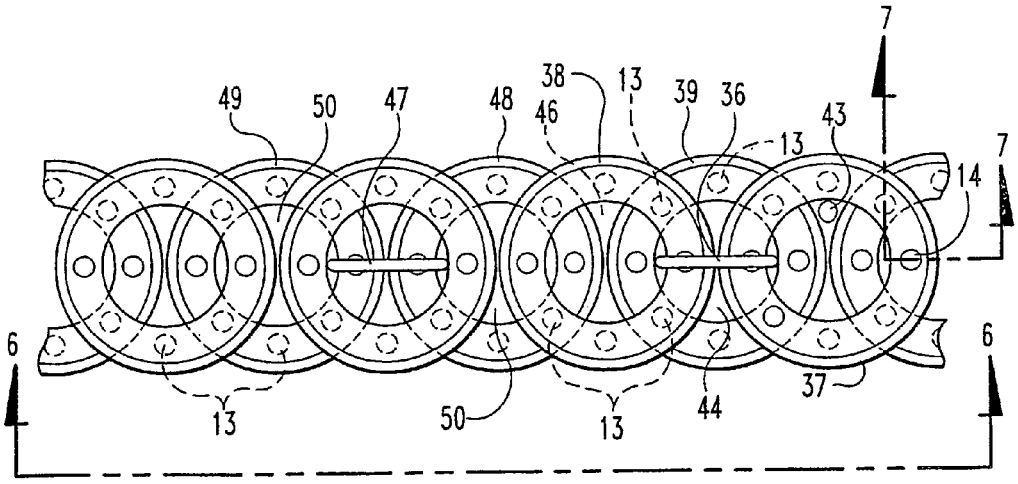
FIG. 5 is a fragmentary top plan view of a third embodiment of the present invention.

Referring now to FIGS. 5 and 6, this arrangement of tires, stacked as they are, has an appearance in the elevational view of FIG. 6 which may be likened to the "running bond" in brick laying. This arrangement may also serve well as a highway median barrier, a ranch fence, noise fence and a visibility screening wall. This configuration probably has more aesthetic appeal than the one shown in FIGS. 3 and 4, and this may be very important to its public acceptability, which is uncertain despite the other benefits provided. Again, as in the previously described embodiments, the tires used in this example will also have holes in the downwardly facing sidewalls for drainage of water. They also may have holes located such as at 14 in the upper sidewalls. These can be used for binding and/or for stakes. But because of the arrangement in this example, binding devices are woven through adjacent tires in a course and a staggered tire in the next course and adjacent tires in the next course. This can be seen at the binding 36 between the tires 37 and 38 and running down through tire 39 and tires 41 and 42. The "running bond" configuration increases the tensile strength of the fence. It is less dependent upon the strength of the binding and more nearly equal to the accumulated tensile strength of the tires in each stack. As above, with respect to the other arrangements, if anchoring to the ground in addition to the weight of the tires themselves is desired, stakes can be used. Easy locations for such can be found at 43, 44, 46 (FIG. 5) and at various additional locations along the fence. As shown best in FIG. 5, overlap of the tires is such that portions of the wheel openings of the tires are in registry, and thus provide top to bottom passageways for reception of stakes. Therefore a stake can be advanced from the top through the wheel opening of a tire in the upper course and through the wheel openings of tires in lower courses and anchored to or in a concrete or other pad or support surface or into the ground. But, as mentioned above, for highway median or other applications, where some impact energy absorption and flexibility are desired, bottom anchorage or ground staking may be eliminated or minimized. As the binding 36 shown at the top of the tires 37 and 38 is installed down through other tires below them, additional attachment may be provided between tires in each course such as shown, for example, at the binding 47 between tires 48 and 49 in the middle course and looped around the tire portions where the tread of tire 48 engages the tread of tire 49 at 50. This can be done at all locations where the tire treads contact each other as at 50. Tire tread strips can be used for bindings. Binding devices in the form of bolts through the treads such as 51 (FIG. 7) can be used too at the tread engagement locations such as 50, for example. Bindings 36 and 47 can be tire tread strips or other materials such as mentioned above with reference to FIGS. 1 and 2.

Figure 10A:
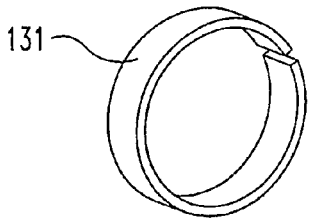
FIG. 10A is a view of a tire tread cut from the tire carcass and cut across the tread.
Figure 10B:
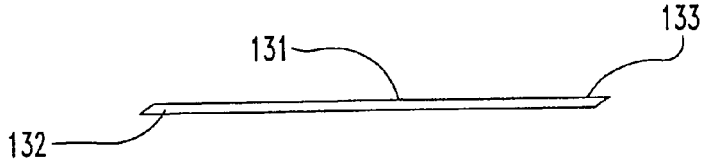
FIG. 10B is a view of the cut tire tread of FIG. 10A and laid out flat.
Figure 11:
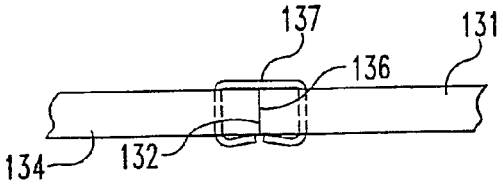
FIG. 11 is a fragmentary view of the tire treads cut from two tires and laid out flat, with two butt ends connected with staples.
Figure 12:
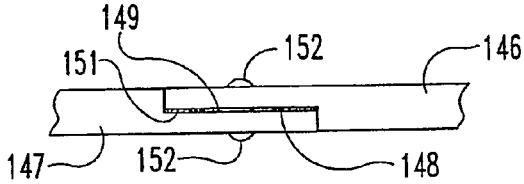
FIG. 12 is a view like FIG. 11 but with overlapping ends connected with adhesive.
Figure 13:
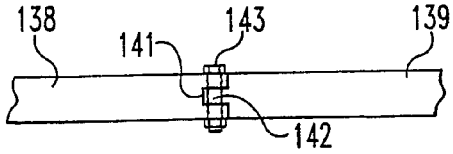
FIG. 13 is a view like FIG. 11 but with ends fitted in a mortise and tenon configuration and connected by threaded fastener.

For use of tire tread strips, the sidewalls can be cut from the tread portion of the tire carcass leaving a ring of tire material which can be cut transverse to the axis and laid out flat, as shown at 131 in FIG. 10B where it has the ends 132 and 133. A plurality of such strips can be connected together in series from as many tires as needed for the desired length of binding of tires in the fence. Where it is desired to connect the two strips together such as strips 131 and 134, as in FIG. 11, the butt-end 132 of strip 131 is placed immediately against the end 136 of strip 134 and connected by one or more staples such as staple 137. Alternatively, the ends of two strips could be joined as in a mortise and tenon nature as shown in FIG. 13 where strips 138 and 139 have the mortise 141 and tenon 142 inter-fitted and secured by bolts 143. Another possible connection is shown in FIG. 12 where the strips 146 and 147 have their ends stepped as at 148 and 149 and overlapped, with adhesive at 151 between the overlapping surfaces. Rivets 152 may also be used at this location in this embodiment, as well as in the embodiment, as shown in FIG. 13.

Figure 14:
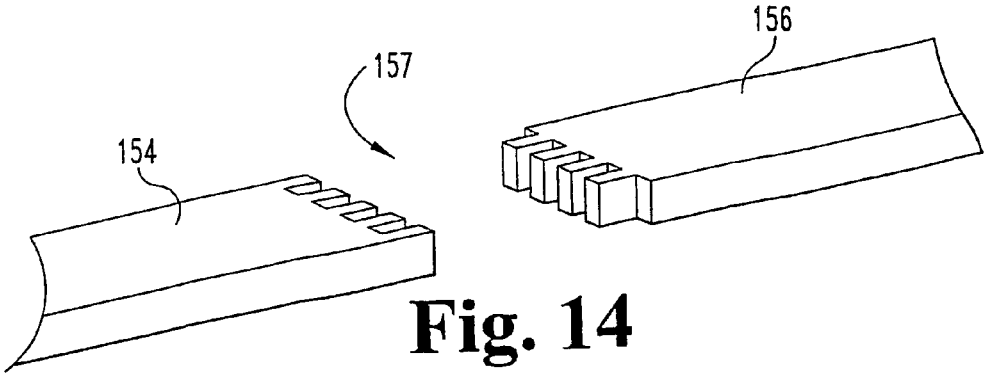
FIG. 14 is a view like FIG. 11 but with ends connected by a hinged clamp.

In the FIG. 14 example, which shows the tread strips 154 and 156, the ends of the tread strips are cut in a dove-tail fashion as shown at 157, and can be glued or stapled at that location to connect the two strips together.

Figure 15:
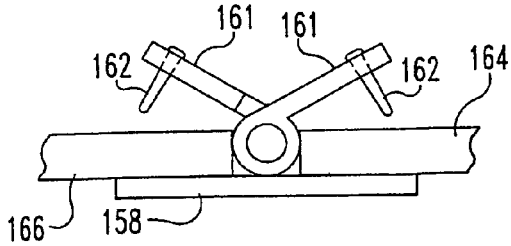
FIG. 15 is a perspective view of end portions of two tire tread strips having inter-fitting dovetail cut configuration for holding them together.

FIG. 15 shows another example of an end connection in which a hinged clamp with a base plate 158 having a hinge assembly 159 secured to it, and plates 161 at each side of the hinge pin, and having spikes 162, on them, can be used to connect the butt-ends of tread strips 164 and 166 together. So it is seen that a variety of means are available to connects the ends of tread strips to make bindings as long as are desired and convenient to use in assembling the tire fence. Moreover, these assembly devices and methods need not be performed in the factory but can be easily performed at the fence installation site for the convenience of the workers building the fence. Also, it should be noted that, since different waste tires may have different tread thicknesses, tread material can be shaved from the tire before or after separating the sidewalls, depending on the flexibility desired for assembly of the tread strips into a tire fence. Most tires have reinforcing metal or fabric cord in the tread portion of the carcass, which is beneficial from a strength standpoint in the tread strips, while not detrimental to flexibility.

Figure 8A:
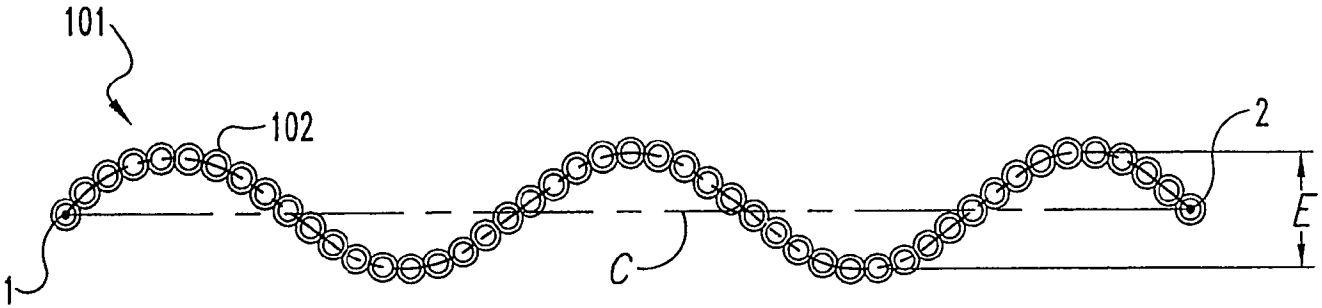
FIGS. 8A, 8B and 8C are schematic top plan views on a small scale of three different profiles of highway median fences which can be made with assemblies such as shown in FIGS. 1 through 6.

Referring now to FIGS. 8A-8C and 9, FIGS. 8A-8C show three of many possible profiles of highway median fences as viewed from above. One profile example shown in FIG. 8A is a row 101 of tires 102 bound together with some of the kinds of bindings described above. The tires are placed in a sine wave type of pattern or profile. The illustration represents, for example, a highway median fence one hundred feet in length from point 1 to point 2, having a single row of stacked tires, and a maximum overall original excursion "E" of the original positions of the tires from the centerline "C" of the row, of about fourteen feet.

Figure 8B:
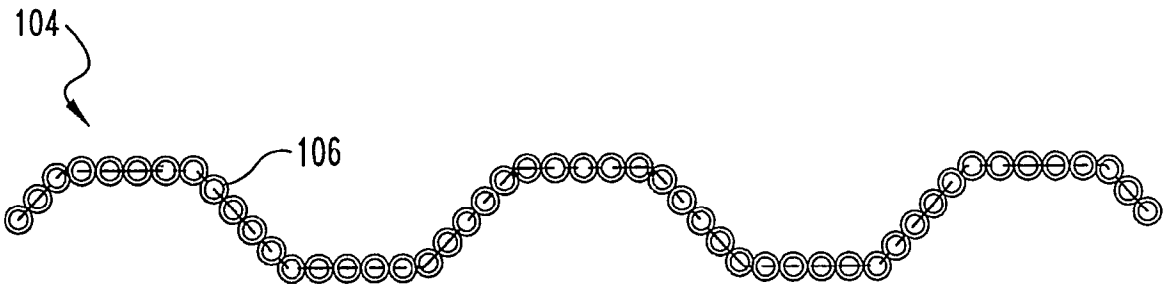
Figure 8C:
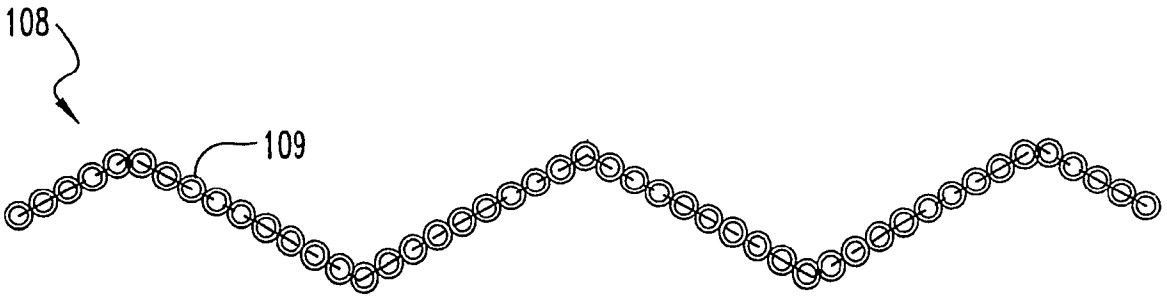

FIG. 8B shows a row 104 of tires 106 and may be referred to as a trapezoidal pattern in which the length is one hundred feet and the width from peak to peak is ten feet. FIG. 8C shows a row 108 of tires 109 arranged in a sawtooth profile.

Figure 9:
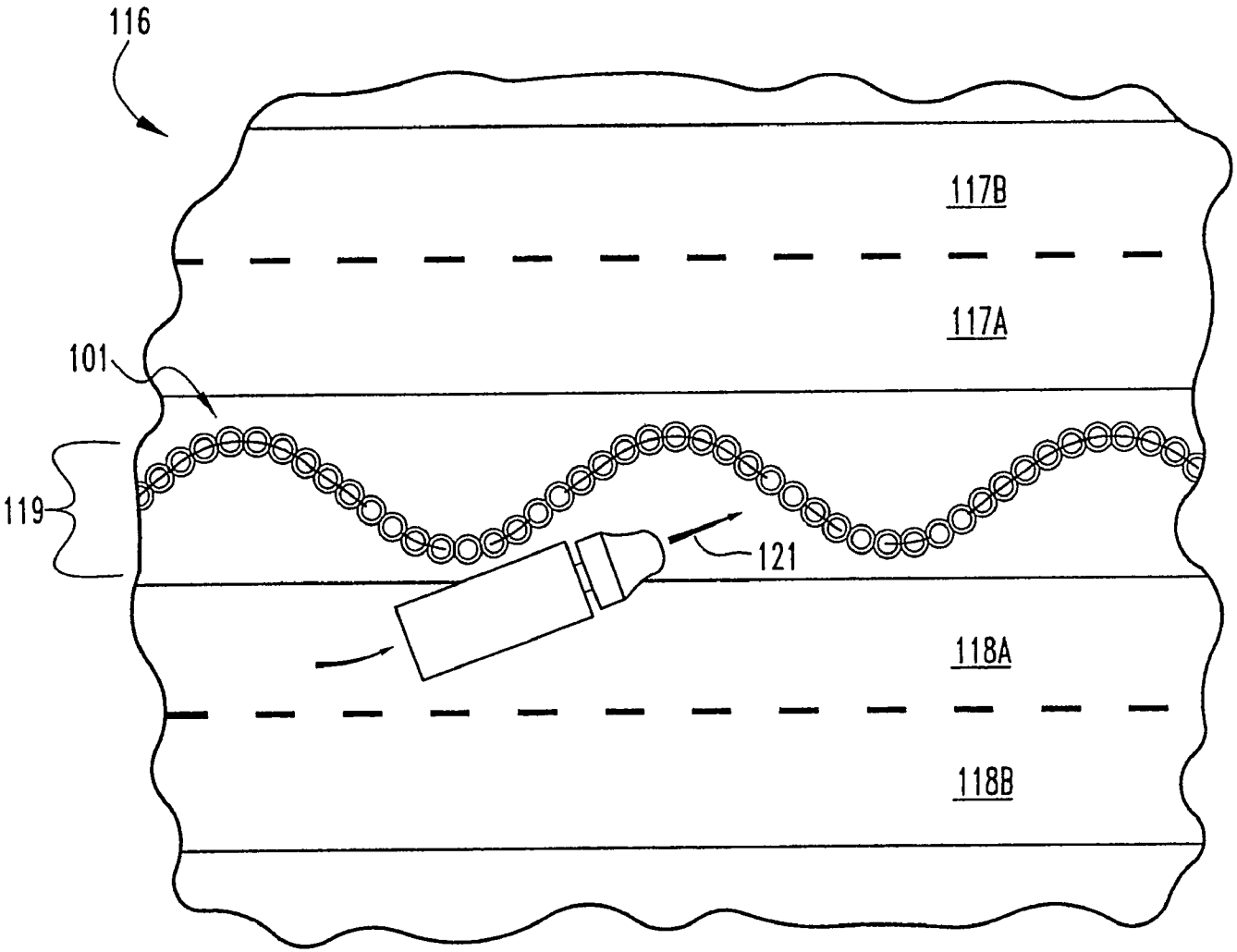
FIG. 9 is a schematic top plan view of a highway with a divider median and showing the fence of FIG. 5A in place, and showing a vehicle veering toward the fence.

FIG. 9 represents a portion of a divided highway 116, with two lanes 117A and 117B for travel in one direction, and two lanes 118A and 118B for travel in the opposite direction. A grassy median 119 is provided between the inner lanes 117A and 118A. Fence 101 according to the present invention is built on the median between the inner lanes 117A and 118A. Truck 121 is out of control and headed toward collision with the fence. As mentioned above, many different profiles can be used. Also, more than one row of tires may be used in a fence built according to the invention. Also, as suggested above in the discussion of the embodiment of FIGS. 5 and 6, fences built according to this invention may be built directly on the ground or on pads or bases assembled or fabricated of various natural or man-made materials. Also, as mentioned above, consistent with the desire for good and effective usage of used tires, tire treads can be used as binding devices. The drainage and binding or shaft receiver holes may be effectively produced by punching slugs or "knock-outs" from the tires, leaving the holes. While they may be made round, they may be made other shapes. Oval, elongate rectangular and diamond are just a few examples. They may be used in the fence for a variety of purposes. Examples are for leveling, for spacing between facing treads in a course, for spacing between a bottom tire and the ground or other support surface to facilitate drainage, or for spacing between a tire and a tire under it for the same, or for other reasons. If a hole is made elongate and long enough, cabling can be wrapped around the slug and the slug used as a wedge or cable tightness adjuster. Thus, according to the present invention, the entire used tire and slugs removed from it can be put to constructive use.

Figure 16:
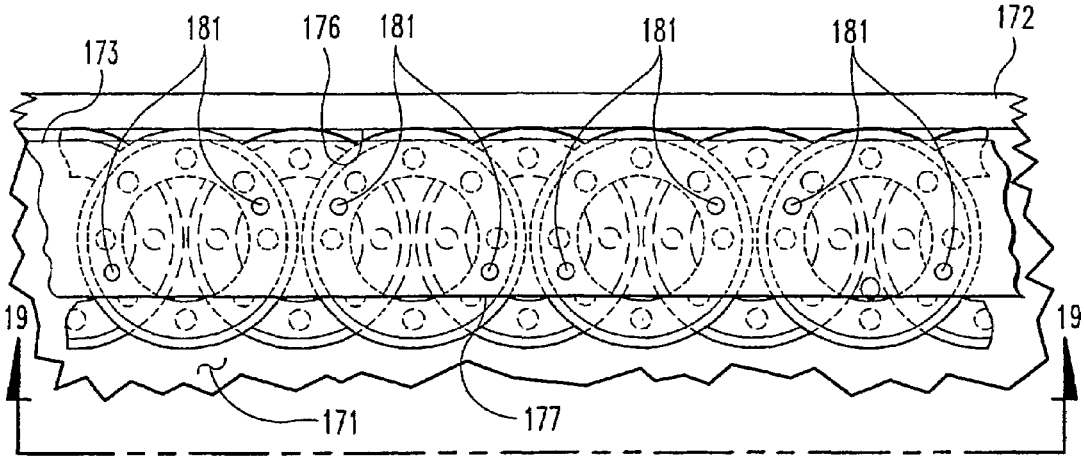
FIG. 16 is a top view of a bumper fence with shelf and representing another embodiment of the present invention.
Figure 17:
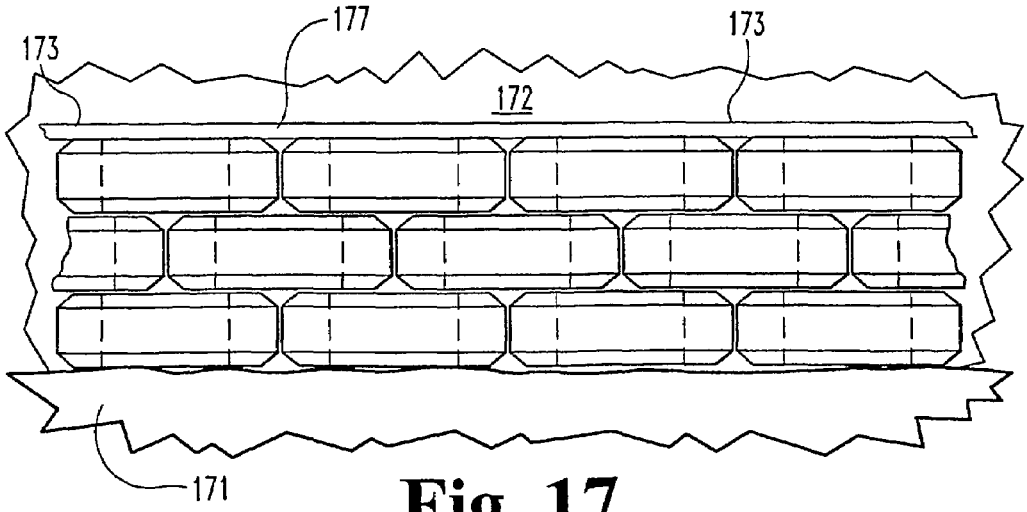
FIG. 17 is a front view of the bumper fence of FIG. 16.

Referring now to FIGS. 16 and 17, the top and front views of the bumper fence embodiment of my invention are shown. In this embodiment, the tires can be arranged and bound as in the FIGS. 5 and 6 embodiment, for example, but are resting on a floor 171 of a building and up against a wall 172 of the building. A shelf or counter 173 is mounted on top of the top course of tires with the rear edge 174 of the shelf spaced from the face 176 of the wall. The front edge of the shelf 177 is spaced somewhat to the rear of an imaginary plane touching the forwardmost extremities of the tires. The shelf may be made of any suitable material and secured to the stack of tires by any convenient way. One example is screws 181 through a wood board and into the sidewalls of the tires immediately under the boards.

Figure 18:
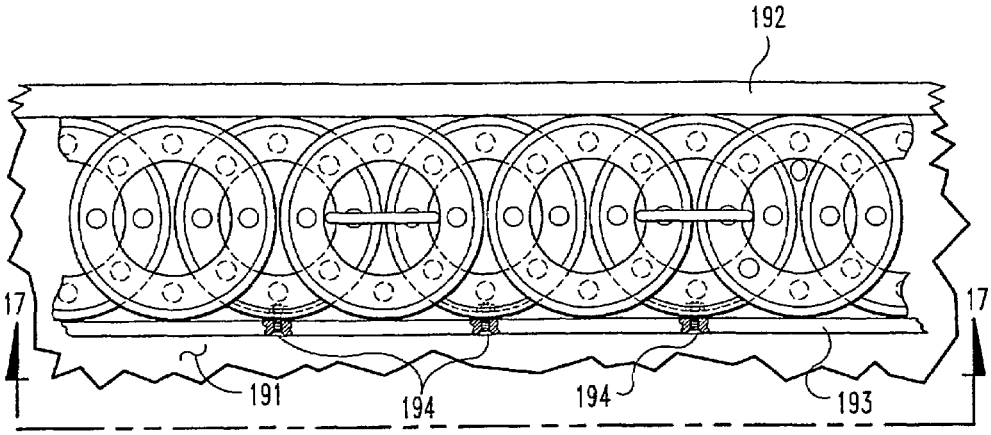
FIG. 18 is a top view of a bumper fence with an impact distributor board on the front according to another embodiment of the present invention.
Figure 19:
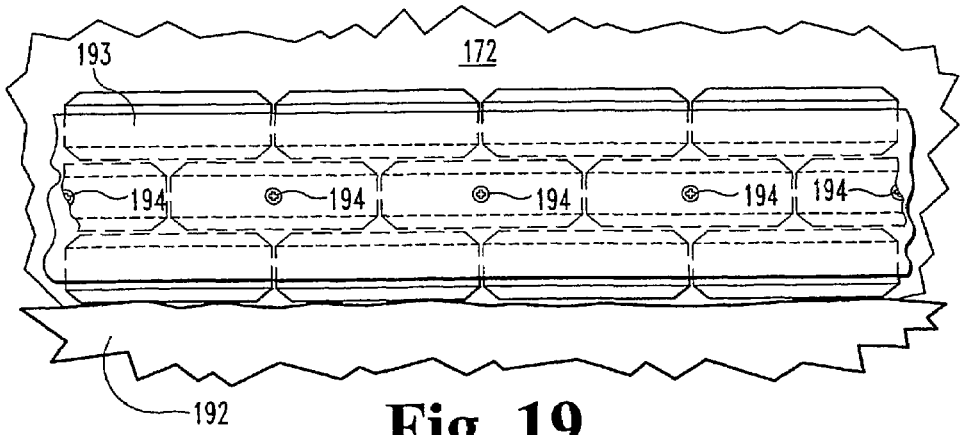
FIG. 19 is a front view of the FIG. 18 embodiment.

Referring now to FIGS. 18 and 19, FIG. 18 is a top view of a bumper fence mounted on a building floor 191 in front of a building wall 192. The tires are arranged as in FIGS. 5 and 6 but up against the building wall 192. A load distributor panel 193 is fastened to the front of the bumper fence by fasteners such as 194 passing through the panel 193 into the tires. The distributor panel may be made of a material of some rigidity so that impact against it will be distributed among several tires at both sides from the impact. One example of panel is a wood board fastened by screws to tire treads in a manner similar to how the shelf in FIGS. 16 and 17 is fastened to the tire sidewalls.

My invention provides a method of disposal of used tires that prevents the collection of stagnant water, thus eliminating the mosquito breeding potential. My invention further spreads, the waste tires into a long linear formation that minimizes the chance of catching a fire and, if ignited, is much more readily extinguished than less linear formation would be. My invention requires very little energy to alter the used tire and use it in a way that is safe. It further makes the tire into something useful, rather than a liability, so the used tire can be asset in its altered, safe form and use.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. It should be understood that where the word "hole" or "holes" is used in the claims which follow, it is to be interpreted as a hole or holes intentionally placed, and not accidentally, occurring, in the tire.

The invention claimed is:

1. A fence comprising:

a plurality of tires, each tire having a cylindrical axis and a tread portion and two spaced sidewalls joined to said tread portion and defining a wheel opening centered on said axis, and wherein:

said tires are laid with one of their sidewalls facing downward, said tires are arranged in original locations adjacent one another in a line defining at least one row, with an original row profile, said row has at least a first course and a second course of said tires therein, the tires in the first course being a bottom course and laid on a stationary supporting surface so as to be slidable together alone said supporting surface and laterally of said original row profile, the tires in the second course being placed on top of the tires of said first course and increasing the height of the fence but maintaining the original row profile, adjacent tires in the first course and adjacent tires in the second course being spaced apart along said original row profile and adjacent tires in the second course being placed in staggered relationship to the tires of such that adjacent tires in the second course are located between and partially overlap adjacent tires in the first course along said original row profile binding devices holding said tires in said first course together and holding said tires in said second course together; and wherein:

said binding devices are sufficiently loose to enable flexibility of the fence in the event of a collision of a moving vehicle with the fence, whereby those of said tires nearest the initial collision impact location and, sequentially others of said tires further from the said impact location, are moveable out of their original locations within said original row profile, to form a second row profile and lessen tension initially placed on the binding devices by impact of the vehicle with the fence and thereby lessen the potential for breakage of the binding devices and thereby enable a change of the row profile by said collision from said original row profile to said second profile without breaking the row apart while gradually decreasing the vehicle velocity; and the fence further comprising:

additional courses of said tires superimposed on said second course and maintaining said original row profile and wherein:

some of said binding devices comprise a first set of elongate tread strips which have ends and extend through said wheel openings and are wrapped around at least two of said tires which are adjacent to each other in said first course and bind said adjacent tires together in said first course;

some of said binding devices comprise assemblies of elongate tire tread strips which have ends and are connected in series and extend through vertically aligned portions of said wheel openings of tires in vertically superimposed courses and are wrapped around vertically aligned portions of said tires in multiple courses and bind said tire portions together;

said tread strips being elongate and having ends; and wherein the end of at least one of said tread strips is connected to the end of another of said tread strips to close said one and another tread strips together after wrapping, and binding said tires together in superimposed courses.

2. The fence of claim 1 and wherein at least some of said tires have at least one hole in the downwardly facing sidewall thereof to allow drainage of water from the inside of said some tires.

3. The fence of claim 2 and wherein:

tires of one of said courses are laid atop tires of another of said courses, and each tire of said one course is offset relative to the tire on which it is laid and covers less than half of the wheel opening of the said tire on which it is laid.

4. The fence of claim 1 wherein said additional courses comprise at least a third course of tires in said row with said original row profile and wherein said tires of said third course have wheel openings, certain ones of said tires in said third course having at least portions of said wheel openings aligned with at least portions of said wheel openings of certain ones of said tires in said first and second courses, said fence further comprising binding devices extending through the aligned portions of the wheel openings of the tires of the first, second and third courses, binding said tires together both laterally and vertically.

5. The fence of claim 1 and wherein threaded fasteners connect the end of said one of said tread strips to the end of another of said tread strips.

6. The fence of claim 1 and wherein the ends of said one and another tread strips have inter-fitting mortise and tenon shapes.

7. The fence of claim 1 and wherein the ends of said one and another tread and are connected by adhesive.

8. The fence of claim 1 and wherein a hinged clamp connects the end of said one of said tread strips to the end of another of said tread strips.

9. The fence of claim 1 and wherein the ends of said one and another tread strips have inter-fitting dovetail shapes.

* * * * *

UNITED STATES PATENT AND TRADEMARK OFFICE

CERTIFICATE OF CORRECTION

PATENT NO. : 7,387,295 B2
APPLICATION NO. : 10/513714
DATED : June 17, 2008
INVENTOR(S) : Alex F. Talbott It is certified that error appears in the above-identified patent and that said Letters Patent is hereby corrected as shown below:

In column 5, line 47, please change
"and showing the fence of FIG. 5A" to --and showing the fence of FIG. 8A--

In column 10, line 50, please change
"so as to be slidable together alone" to --so as to be slidable together along--

In column 10, line 58, please change
"staggered relationship to the tires of" to --staggered relationship to the tires of said first course--

In column 12, line 1, please change
"The fence of claim 2" to --The fence of claim 1"--

In column 12, line 30, please change
"and another tread and are connected by adhesive." to --and another tread strips are overlapping and are connected by adhesive.--

Signed and Sealed this

Twelfth Day of August, 2008

JON W. DUDAS
*Director of the United States Patent and Trademark Office*